US008072159B2

(12) United States Patent
Chen et al.

(10) Patent No.: US 8,072,159 B2
(45) Date of Patent: Dec. 6, 2011

(54) MULTI-LAMP DRIVING CIRCUIT

(75) Inventors: Chien-Hung Chen, Jhongli (TW); Chin-Po Cheng, Jhongli (TW); Yong-Long Lee, Jhongli (TW)

(73) Assignee: Ampower Technology Co., Ltd., Jhongli, Taoyuan County (TW)

( * ) Notice: Subject to any disclaimer, the term of this patent is extended or adjusted under 35 U.S.C. 154(b) by 451 days.

(21) Appl. No.: 12/416,163

(22) Filed: Apr. 1, 2009

(65) Prior Publication Data

US 2010/0181931 A1 Jul. 22, 2010

(30) Foreign Application Priority Data

Jan. 16, 2009 (CN) ..... 2009 2 0129514 U

(51) Int. Cl.
*H05B 41/36* (2006.01)

(52) U.S. Cl. ..... 315/297; 315/277; 315/282; 315/312; 315/291

(58) Field of Classification Search ..... 315/224, 315/255, 257, 274–277, 279, 282, 291, 307, 315/312, 324, 246, 294, 209 R
See application file for complete search history.

(56) References Cited

U.S. PATENT DOCUMENTS

| | | | | |
|---|---|---|---|---|
| 6,781,325 | B2 * | 8/2004 | Lee | 315/282 |
| 7,242,147 | B2 * | 7/2007 | Jin | 315/177 |
| 7,285,921 | B2 * | 10/2007 | Chen | 315/291 |
| 7,294,971 | B2 * | 11/2007 | Jin | 315/177 |
| 7,573,205 | B2 * | 8/2009 | Hosaka et al. | 315/277 |
| 7,671,540 | B2 * | 3/2010 | Lee et al. | 315/282 |
| 7,759,877 | B2 * | 7/2010 | Bai et al. | 315/277 |
| 7,872,424 | B2 * | 1/2011 | Sun et al. | 315/219 |
| 7,876,055 | B2 * | 1/2011 | Hosaka et al. | 315/277 |
| 2005/0093471 | A1 | 5/2005 | Jin | |

* cited by examiner

*Primary Examiner* — Vibol Tan
(74) *Attorney, Agent, or Firm* — Altis Law Group, Inc.

(57) ABSTRACT

A multi-lamp driving circuit for driving a plurality of lamps includes at least one power stage circuit, at least one transformer circuit, a balancing circuit, and a control circuit. The power stage circuit converts external electrical signals to alternating current (AC) signals. The transformer circuit is connected to the power stage circuit, to convert the AC signals to high voltage electrical signals capable of driving the lamps. The balancing circuit balances current flowing through the lamps, and includes a capacitor balancing circuit and a transformer balancing circuit. The control circuit is connected between the balancing circuit and the power stage circuit, to control output of the power stage circuit according to variation of the current flowing through the lamps.

12 Claims, 7 Drawing Sheets

MULTI-LAMP DRIVING CIRCUIT

BACKGROUND

1. Technical Field

Embodiments of the present disclosure relate to lamp driving circuits, and particularly to a multi-lamp driving circuit.

2. Description of Related Art

Generally, discharge lamps, such as Cold Cathode Fluorescent Lamps (CCFLs) and External Electrode Fluorescent Lamps (EEFLs), require balancing circuits to balance current flowing through the discharge lamps.

Conventional balancing circuits often only utilize capacitors or transformers connected to the discharge lamps. Balancing circuits utilizing only capacitors provide a simple and cost-effective solution, but overall balancing effects suffer. Balancing circuits using only transformers provide better balancing effects, but at a cost increase.

DETAILED DESCRIPTION

Figure 1:
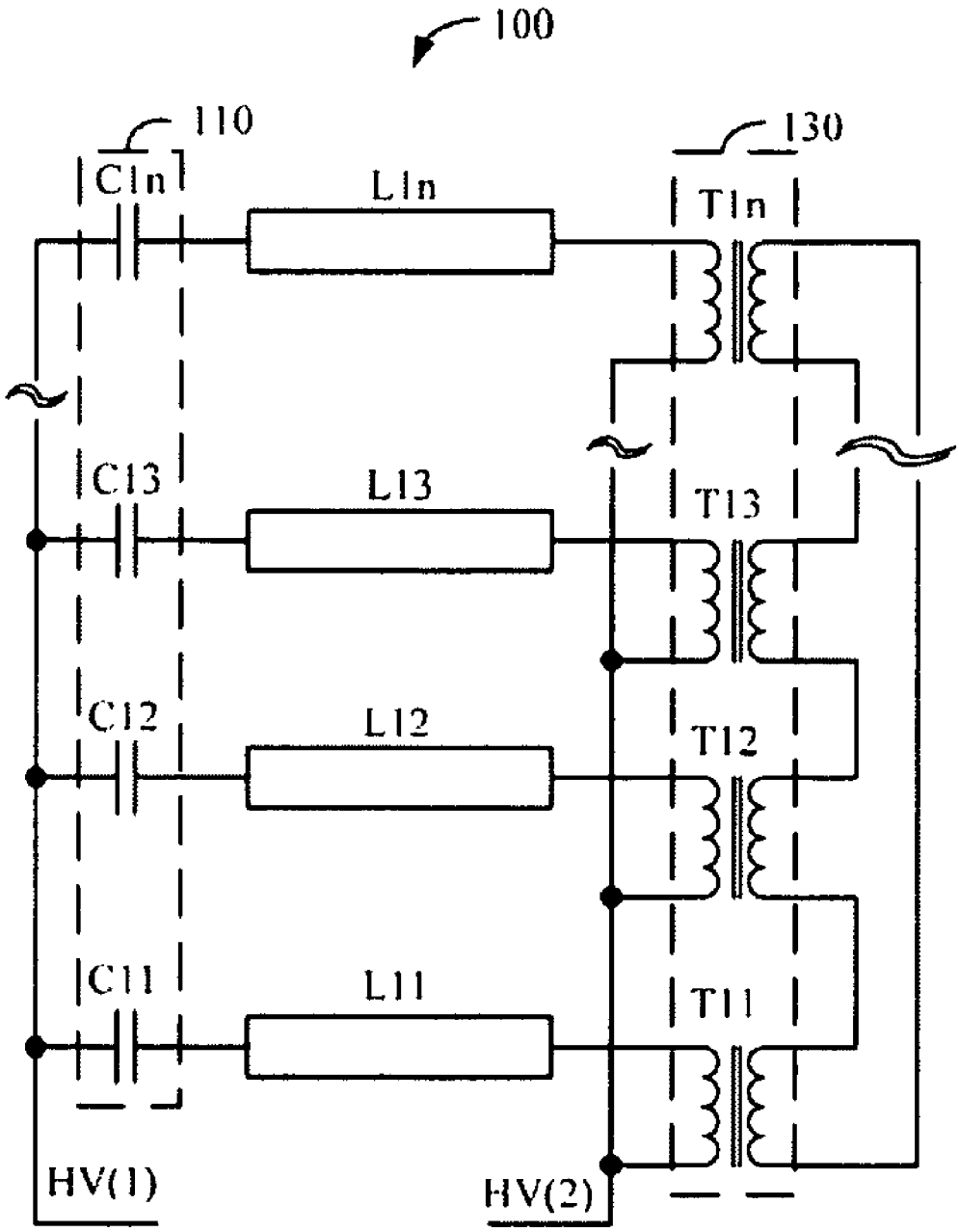
FIG. 1 is a circuit diagram of a balancing circuit for a multi-lamp driving circuit in accordance with the present disclosure.
Figure 2A:
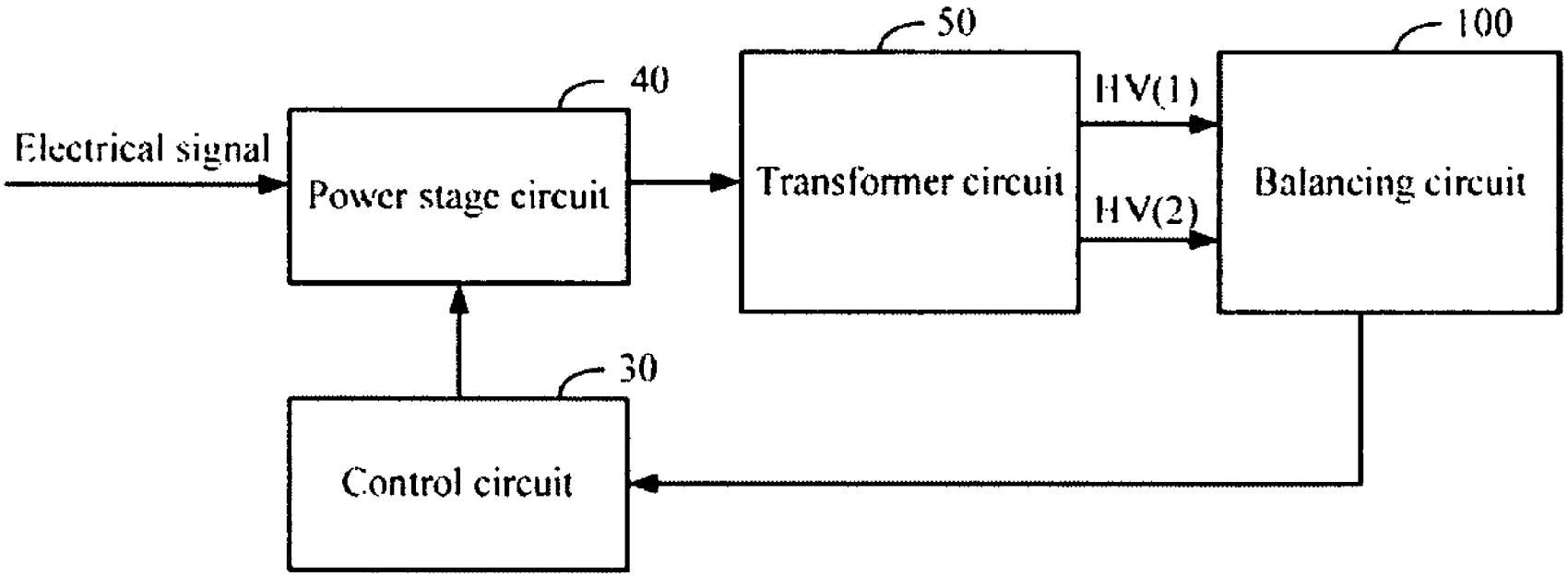
FIG. 2*a* is a schematic diagram of a first embodiment of a multi-lamp driving circuit using the balancing circuit of FIG. 1.

FIG. 1 is a circuit diagram of a balancing circuit 100 for a multi-lamp driving circuit in accordance with the present disclosure. FIG. 2*a* is a schematic diagram of a first embodiment of a multi-lamp driving circuit using the balancing circuit 100 of FIG. 1. The multi-lamp driving circuit drives a plurality of lamps L11, L12, L13 . . . L1*n*, and includes a control circuit 30, a power stage circuit 40, a transformer circuit 50, and the balancing circuit 100. The balancing circuit 100 balances current flowing through the lamps L11, L12, L13 . . . L1*n*, and includes a capacitor balancing circuit 110 and a transformer balancing circuit 130.

The power stage circuit 40 converts external electrical signals to alternating current (AC) signals. The transformer circuit 50 is connected to the power stage circuit 40, to convert the AC signals to high voltage electrical signals capable of driving the lamps L11, L12, L13 . . . L1*n*, and output the high voltage electrical signals via a first output end HV(1) and a second output end HV(2). In this embodiment, the first output end HV(i) and the second output end HV(2) are respectively a negative high voltage output end and a positive high voltage output end, or can respectively be a positive high voltage output end and a negative high voltage output end. The difference between the positive high voltage output end and the negative high voltage output end is only in different phases.

The control circuit 30 is connected between the balancing circuit 100 and the power stage circuit 40, to control output of the power stage circuit 40 according to variation of current flowing through the lamps L11, L12, L13 . . . L1*n*.

As shown in FIG. 1, the capacitor balancing circuit 110 includes a plurality of capacitors C11, C12, C13 . . . C1*n*, connected between the first output end HV(1) of the transformer circuit 50 and first ends of the plurality of lamps L11, L12, L13 . . . L1*n*.

The transformer balancing circuit 130 includes a plurality of transformers T11, T12, T13 . . . T1*n* with first windings and second windings. First ends of the first windings of the plurality of transformers T11, T12, T13 . . . T1*n* are jointly connected to the second output end HV(2) of the transformer circuit 50, second ends of the first windings of the plurality of transformers T11, T12, T13 . . . T1*n* are connected to corresponding second ends of the plurality of lamps L11, L12, L13 . . . L1*n*. The second windings of the plurality of transformers T11, T12, T13 . . . T1*n* are connected end-to-end to form a closed loop. In one embodiment, the control circuit 30 is connected between the closed loop formed by the second windings of the plurality of transformers T11, T12, T13 . . . T1*n* and the power stage circuit 40.

The second winding of each transformer include a first end and a second end. In detail, the first end of the second winding of the transformer T11 is connected to the second end of the second winding of the transformer T12, and the first end of the second winding of the transformer T12 is connected to the second end of the second winding of the transformer T13. The first end of the second winding of the transformer T1(*n*−1) is connected to the second end of the second winding of the transformer T1*n*, and the first end of the second winding of the transformer T1*n* is connected to the second end of the second winding of the transformer T11.

Figure 2B:
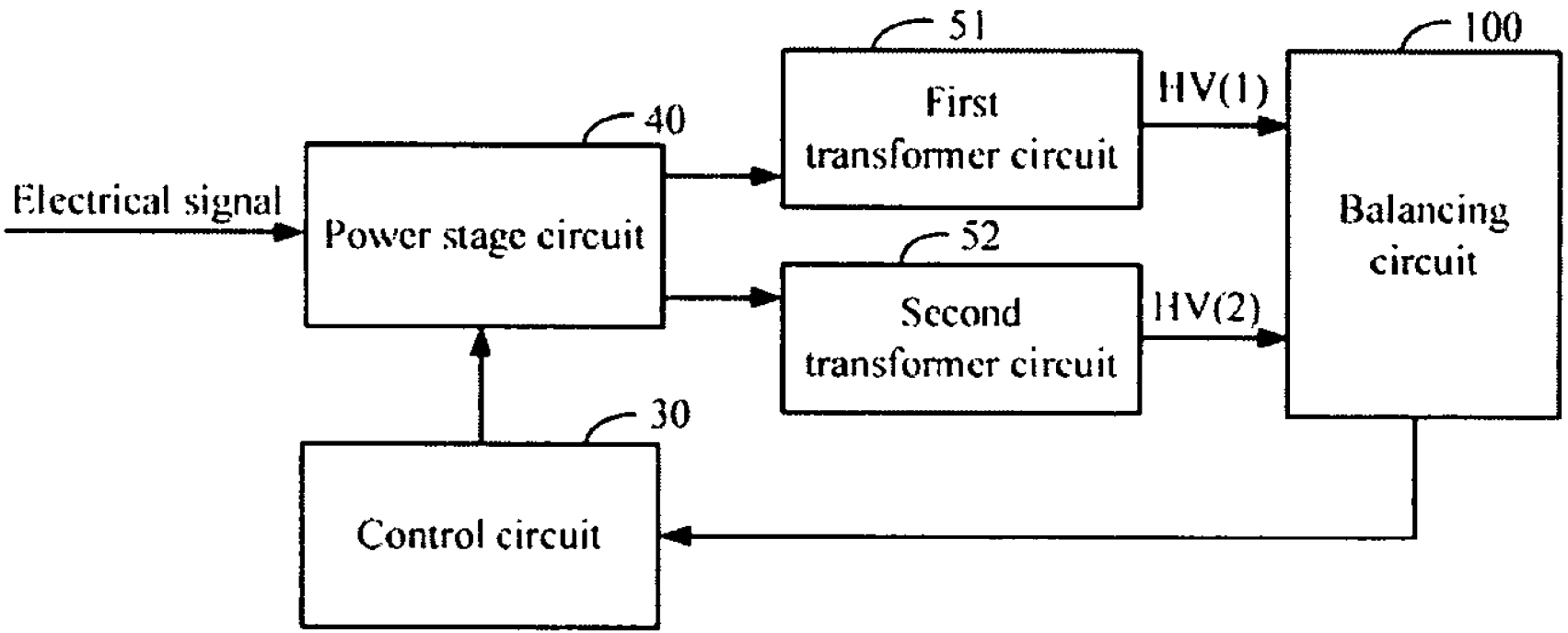
FIG. 2*b* is a schematic diagram of a second embodiment of a multi-lamp driving circuit using the balancing circuit of FIG. 1.

FIG. 2*b* is a schematic diagram of a second embodiment of a multi-lamp driving circuit using the balancing circuit 100 of FIG. 1, differing from the previous embodiment only in the further inclusion of a first transformer circuit 51 and a second transformer circuit 52, providing high voltage electrical signals to the capacitor balancing circuit 110 and providing high voltage electrical signals to the transformer balancing circuit 130, respectively, as shown in FIG. 1.

Figure 2C:
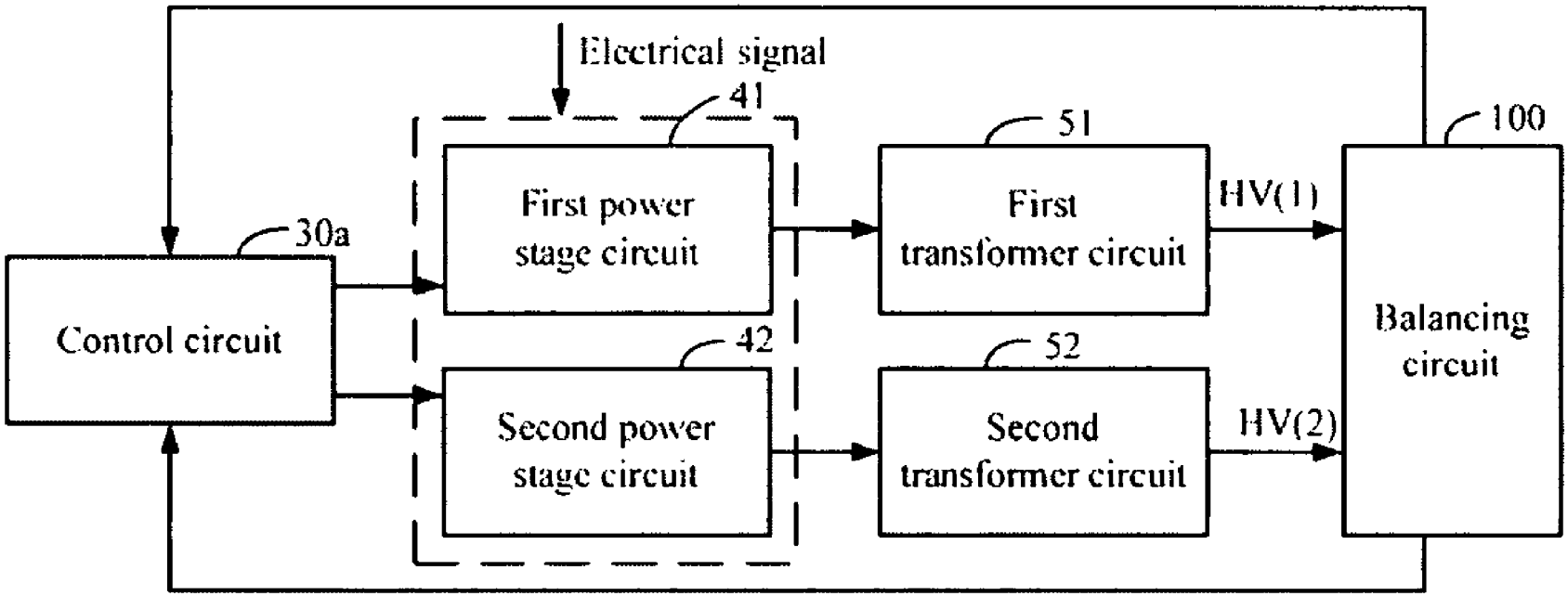
FIG. 2*c* is a schematic diagram of a third embodiment of a multi-lamp driving circuit using the balancing circuit of FIG. 1.

FIG. 2*c* is a schematic diagram of a third embodiment of a multi-lamp driving circuit using the balancing circuit 100 of FIG. 1, differing from the second embodiment only in the further inclusion of a first power stage circuit 41 and a second power stage circuit 42, providing AC signals to the first transformer circuit 51 and the second transformer circuit 52, respectively. The first transformer circuit 51 is connected between the first power stage circuit 41 and the capacitor balancing circuit 110 of FIG. 1, to provide high voltage electrical signals to the capacitor balancing circuit 110. The second transformer circuit 52 is connected between the second power stage circuit 42 and the transformer balancing circuit 130 of FIG. 1, to provide high voltage electrical signals to the transformer balancing circuit 130 shown in FIG. 1.

In addition, the control circuit 30*a* of FIG. 2*c* includes a first input connected to the capacitor balancing circuit 110 of FIG. 1, a second input connected to the transformer balancing circuit 130 of FIG. 1, a first output connected to the first power stage circuit 41, and a second output connected to the second power stage circuit 42. The control circuit 30*a* obtains a first current variation from the capacitor balancing circuit 110 to control output of the first power stage circuit 41, and obtains a second current variation from the transformer balancing circuit 130 to control output of the second power stage circuit 42.

Figure 3:
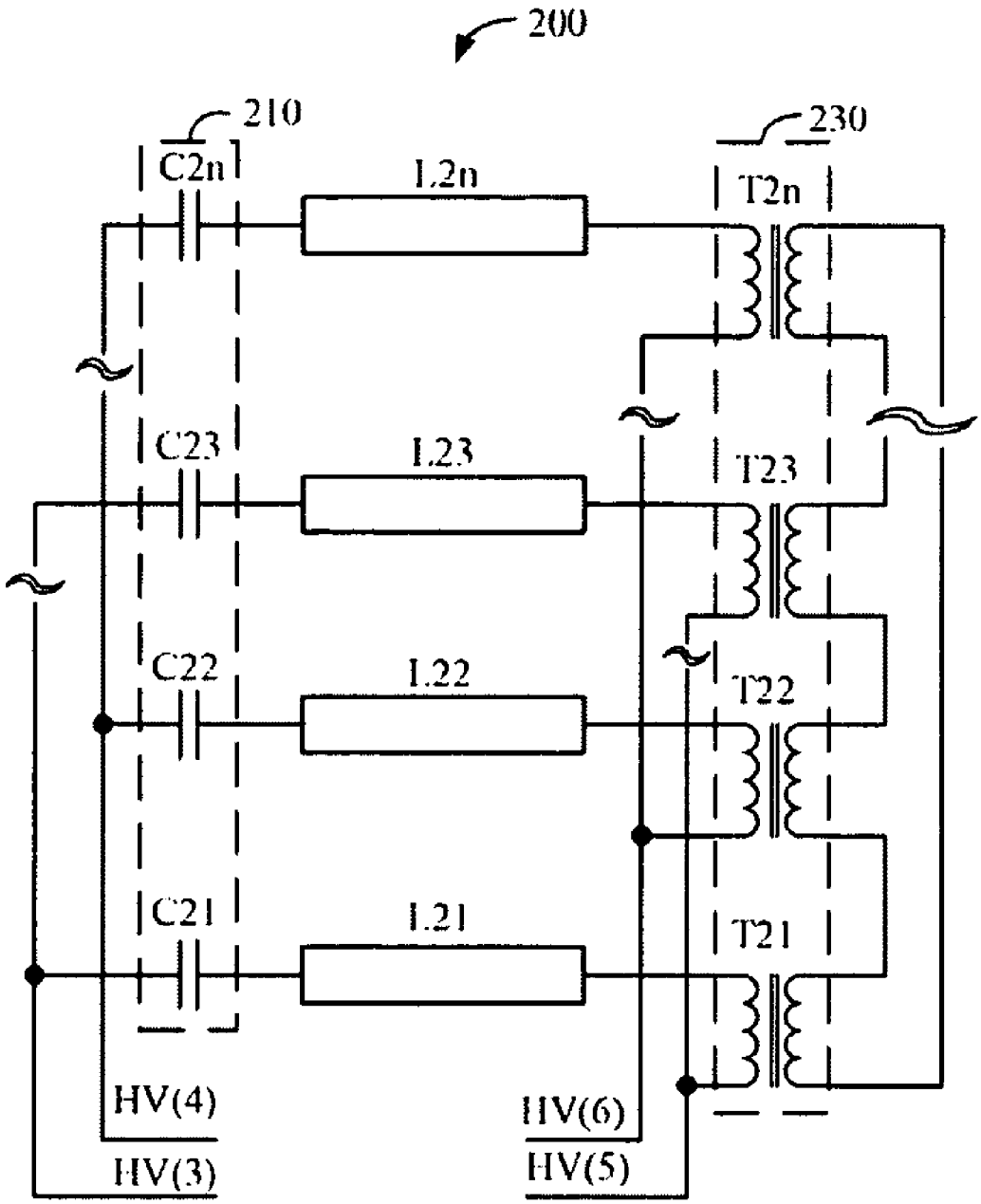
FIG. 3 is a circuit diagram of another balancing circuit for a multi-lamp driving circuit in accordance with the present disclosure.
Figure 4A:
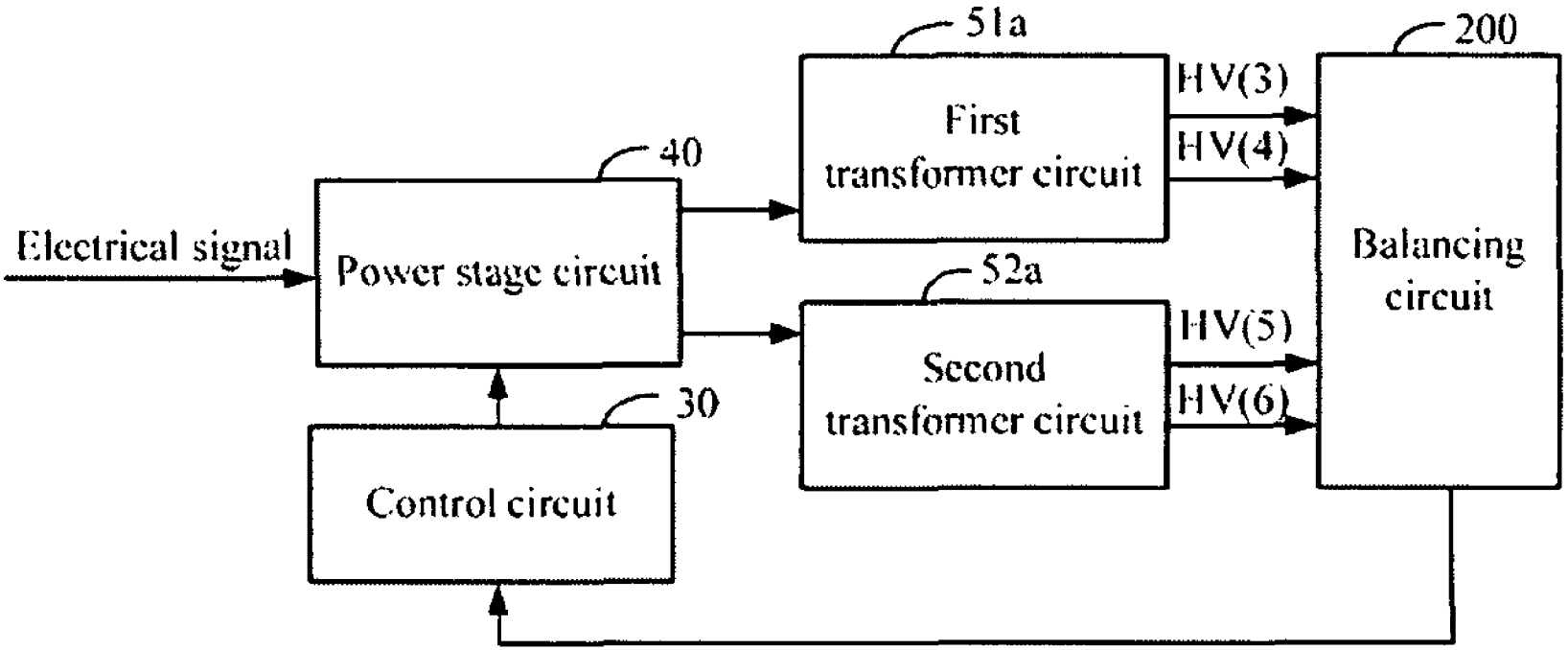
FIG. 4*a* is a schematic diagram of a first embodiment of a multi-lamp driving circuit using the balancing circuit of FIG. 3.

FIG. 3 is a circuit diagram of another balancing circuit 300 for a multi-lamp driving circuit in accordance with the present disclosure. FIG. 4*a* is a schematic diagram of a first embodiment of a multi-lamp driving circuit using the balancing circuit 200 of FIG. 3. The multi-lamp driving circuit drives a plurality of lamps L21, L22, L23 . . . L2*n*, and includes a control circuit 30, a power stage circuit 40, a first transformer circuit 51*a*, a second transformer circuit 52*a*, and the balancing circuit 200. The balancing circuit 200 balances current flowing through the lamps L21, L22, L23 . . . L2*n*, and includes a capacitor balancing circuit 210 and a transformer balancing circuit 230.

The power stage circuit 40 converts external electrical signals to AC signals. The first transformer circuit 51*a* is connected to the power stage circuit 40, to convert the AC signals to high voltage electrical signals capable of driving the lamps L21, L22, L23 . . . L2*n* and output the high voltage electrical signals via a third output end HV(3) and a fourth output end HV(4).

The second transformer circuit 52*a* is connected to the power stage circuit 40, to convert AC signals to high voltage electrical signals capable of driving the lamps L21, L22, L23 . . . L2*n* and output the high voltage electrical signals via a fifth output end HV(5) and a sixth output end HV(6).

In an example, the third output end HV(3), the fourth output end HV(4), the fifth output end HV(5), and the sixth output end HV(6) can include a positive high voltage output end, a negative high voltage end, a negative high voltage output end, and a positive high voltage output end, respectively.

In another example, the third output end HV(3), the fourth output end HV(4), the fifth output end HV(5), and the sixth output end HV(6) can include a negative high voltage output end, a positive high voltage end, a positive high voltage end, and a negative high voltage output end, respectively.

The control circuit 30 is connected between the balancing circuit 200 and the power stage circuit 40, to control output of the power stage circuit 40 according to variation of the current flowing through the lamps L21, L22, L23 . . . L2*n*.

Referring to FIG. 3, the capacitor balancing circuit 210 includes a plurality of capacitors C21, C22, C23 . . . C2*n* divided into two equal groups. First ends of the two groups of capacitors C21, C22, C23 . . . C2*n* are connected to corresponding first ends of the plurality of lamps L21, L22, L23 . . . L2*n*. Second ends of a first group of capacitors, such as the capacitors C21, C23, C25, . . . , C2(*n*−1), are jointly connected to the third output end HV(3) of the first transformer circuit 51*a*. Second ends of a second group of capacitors, such as the capacitor C22, C24, C26, . . . , C2*n*, are jointly connected to the fourth output end HV(4) of the first transformer circuit 51*a*.

The transformer balancing circuit 230 includes a plurality of transformers T21, T22, T23 . . . T2*n* divided into two equal groups. Each transformer includes a first winding and a second winding. First ends of the first windings of the two groups of transformers T21, T22, T23 . . . T2*n* are connected to corresponding second ends of the plurality of lamps L21, L22, L23 . . . L2*n*. Second ends of the first windings of a first group of transformers, such as the transformers T21, T23, T25, . . . , T2(*n*−1), are jointly connected to the fifth output end HV(5) of the second transformer circuit 52*a*. Second ends of the first windings of a second group of transformers, such as the transformers T22, T24, T26, . . . , T2*n*, are jointly connected to the sixth output end HV(6) of the second transformer circuit 52*a*. The second windings of the two groups of transformers T21, T22, T23. T2*n* are connected end-to-end to form a closed loop. In one embodiment, the control circuit 30 is connected between the closed loop formed by the second windings of the plurality of transformers T21, T22, T23 . . . T2*n* and the power stage circuit 40.

Figure 4B:
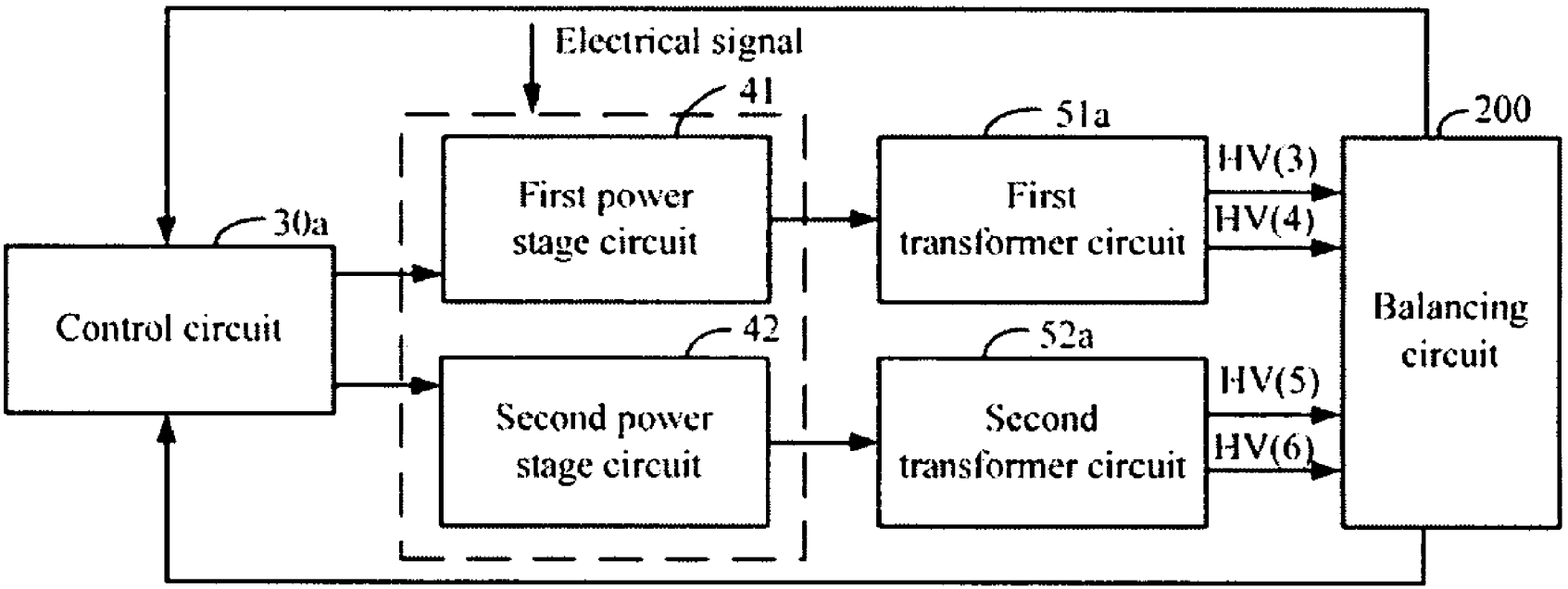
FIG. 4*b* is a schematic diagram of a second embodiment of a multi-lamp driving circuit using the balancing circuit of FIG. 3.

FIG. 4*b* is a schematic diagram of a second embodiment of the multi-lamp driving circuit using the balancing circuit 300 of FIG. 3. The multi-lamp driving circuit of FIG. 4*b* is similar to the multi-lamp driving circuit of FIG. 4*a*, and the difference is in that the multi-lamp driving circuit of this embodiment further includes a first power stage circuit 41 and a second power stage circuit 42, providing AC signals to the first transformer circuit 51*a* and the second transformer circuit 52*a*, respectively. The first transformer circuit 51*a* is connected between the first power stage circuit 41 and the capacitor balancing circuit 210 of FIG. 3, to provide high voltage electrical signals to the capacitor balancing circuit 210. The second transformer circuit 52*a* is connected between the second power stage circuit 42 and the transformer balancing circuit 230 of FIG. 3, to provide high voltage electrical signals to the transformer balancing circuit 230.

In addition, the control circuit 30*a* of FIG. 4*b* comprises a first input connected to the capacitor balancing circuit 210 of FIG. 3, a second input connected to the transformer balancing circuit 230 of FIG. 3, a first output connected to the first power stage circuit 41, and a second output connected to the second power stage circuit 42. The control circuit 30*a* obtains a first current variation from the capacitor balancing circuit 210 to control output of the first power stage circuit 41, and obtains a second current variation from the transformer balancing circuit 230 to control output of the second power stage circuit 42.

Thus, the multi-lamp driving circuit of the present disclosure uses the combination of the capacitor balancing circuits (110 and 210) and the transformer balancing circuits (130 and 230), to provide a better balancing effect and to reduce cost.

While various embodiments and methods of the present disclosure have been described above, it should be understood that they have been presented by way of example only and not by way of limitation. Thus the breadth and scope of the present disclosure should not be limited by the above-described embodiments, but should be defined only in accordance with the following claims and their equivalents.

What is claimed is:

1. A multi-lamp driving circuit for driving a plurality of lamps, comprising:

at least one power stage circuit that converts external electrical signals to alternating current signals;

at least one transformer circuit connected to the at least one power stage circuit, the at least one transformer circuit for converting the alternating current signals to high voltage electrical signals capable of driving the plurality of lamps, and outputting the high voltage electrical signals via a first output end and a second output end;

a balancing circuit that balances current flowing through the plurality of lamps, the balancing circuit comprising a capacitor balancing circuit and a transformer balancing circuit; and a control circuit connected between the balancing circuit and the power stage circuit to control output of the power stage circuit according to variation of the current flowing through the plurality of lamps;

wherein the capacitor balancing circuit comprises a plurality of capacitors connected between the first output end of the at least one transformer circuit and first ends of the plurality of lamps;

wherein the transformer balancing circuit comprises a plurality of transformers having first windings and second windings, wherein first ends of the first windings are jointly connected to the second output end of the at least one transformer circuit, second ends of the first windings are connected to corresponding second ends of the plurality of lamps, and the second windings are connected end-to-end to form a closed loop;

wherein the control circuit is connected between the closed loop formed by the second windings of the plurality of transformers of the transformer balancing circuit and the power stage circuit.

2. The multi-lamp driving circuit as claimed in claim 1, wherein the first output end and the second output end of the transformer circuit are a negative high voltage output end and a positive high voltage output end, respectively.

3. The multi-lamp driving circuit as claimed in claim 1, wherein the first output end and the second output end of the transformer circuit are a positive high voltage output end and a negative high voltage output end, respectively.

4. The multi-lamp driving circuit as claimed in claim 1, wherein the at least one transformer circuit comprises a first transformer circuit and a second transformer circuit, providing high voltage electrical signals to the capacitor balancing circuit and the transformer balancing circuit, respectively.

5. The multi-lamp driving circuit as claimed in claim 4, wherein:

the at least one power stage circuit comprises a first power stage circuit and a second power stage circuit, providing alternating current signals to the first transformer circuit and the second transformer circuit, respectively;

the first transformer circuit is connected between the first power stage circuit and the capacitor balancing circuit; and the second transformer circuit is connected between the second power stage circuit and the transformer balancing circuit.

6. The multi-lamp driving circuit as claimed in claim 5, wherein the control circuit comprises a first input connected to the capacitor balancing circuit, a second input connected to the transformer balancing circuit, a first output connected to the first power stage circuit, and a second output connected to the second power stage circuit, the control circuit configured for obtaining a first current variation from the capacitor balancing circuit to control output of the first power stage circuit, and obtaining a second current variation from the transformer balancing circuit to control output of the second power stage circuit.

7. A multi-lamp driving circuit for driving a plurality of lamps comprising:

at least one power stage circuit that converts external electrical signals to alternating current signals;

a first transformer circuit connected to the power stage circuit, that converts the alternating current signals to high voltage electrical signals capable of driving the lamps and outputs the high voltage electrical signals via a first output end and a second output end;

a second transformer circuit connected to the power stage circuit, that converts the alternating current signals to high voltage electrical signals capable of driving the lamps and outputs the high voltage electrical signals via a third output end and a fourth output end;

a balancing circuit that balances current flowing through the lamps, the balancing circuit comprising a capacitor balancing circuit and a transformer balancing circuit; and a control circuit connected between the balancing circuit and the power stage circuit to control output of the power stage circuit according to variation of the current flowing through the lamps;

wherein the capacitor balancing circuit comprises a plurality of capacitors divided into two equal groups, wherein first ends of the two groups of capacitors are connected to corresponding first ends of the plurality of lamps, second ends of a first group of capacitor are jointly connected to the first output end of the first transformer circuit, and second ends of a second group of capacitors are jointly connected to the second output end of the first transformer circuit;

wherein the transformer balancing circuit comprises a plurality of transformers divided into two equal groups, each transformer comprising a first winding and a second winding, wherein first ends of the first windings of the two groups are connected to corresponding second ends of the plurality of lamps, second ends of the first windings of a first group are jointly connected to the third output end of the second transformer circuit, second ends of the first windings of a second group are jointly connected to the fourth output end of the second transformer circuit, and the second windings of the two groups of transformers are connected end-to-end to form a closed loop.

8. The multi-lamp driving circuit as claimed in claim 7, wherein the first output end, the second output end, the third output end, and the fourth output end are a positive high voltage output end, a negative high voltage end, a negative high voltage output end, and a positive high voltage output end, respectively.

9. The multi-lamp driving circuit as claimed in claim 7, wherein the first output end, the second output end, the third output end, and the fourth output end are a negative high voltage output end, a positive high voltage end, a positive high voltage output end, and a negative high voltage output end, respectively.

10. The multi-lamp driving circuit as claimed in claim 7, wherein the control circuit is connected between the closed loop formed by the second windings of the plurality of transformers of the transformer balancing circuit and the power stage circuit.

11. The multi-lamp driving circuit as claimed in claim 10, wherein:

the at least one power stage circuit comprises a first power stage circuit and a second power stage circuit, providing alternating current signals to the first transformer circuit and the second transformer circuit, respectively;

the first transformer circuit is connected between the first power stage circuit and the capacitor balancing circuit;

the second transformer circuit is connected between the second power stage circuit and the transformer balancing circuit.

12. The multi-lamp driving circuit as claimed in claim 11, wherein the control circuit comprises a first input connected to the capacitor balancing circuit, a second input connected to the transformer balancing circuit, a first output connected to the first power stage circuit, and a second output connected to the second power stage circuit, the control circuit configured for obtaining a first current variation from the capacitor balancing circuit to control output of the first power stage circuit, and obtaining a second current variation from the transformer balancing circuit to control output of the second power stage circuit.

* * * * *